US009302382B2

(12) United States Patent
Tuohy, III et al.

(10) Patent No.: US 9,302,382 B2
(45) Date of Patent: Apr. 5, 2016

(54) MULTI-PURPOSE TOOL

(71) Applicants: Dennis J. Tuohy, III, Newton, NJ (US); Jeannie Tuohy, Newton, NJ (US)

(72) Inventors: Dennis J. Tuohy, III, Newton, NJ (US); Jeannie Tuohy, Newton, NJ (US)

( * ) Notice: Subject to any disclaimer, the term of this patent is extended or adjusted under 35 U.S.C. 154(b) by 384 days.

(21) Appl. No.: 13/849,232

(22) Filed: Mar. 22, 2013

(65) Prior Publication Data

US 2014/0157521 A1 Jun. 12, 2014

Related U.S. Application Data

(60) Provisional application No. 61/797,650, filed on Dec. 12, 2012.

(51) Int. Cl.
*B25F 1/00* (2006.01)

(52) U.S. Cl.
CPC ..... *B25F 1/00* (2013.01)

(58) Field of Classification Search
CPC ..... B25F 1/00; B25F 1/006; B25F 1/02; B44D 3/164; B44D 3/128; B44D 3/162
See application file for complete search history.

(56) References Cited

U.S. PATENT DOCUMENTS 5,203,471 A * 4/1993 Widman ..... 220/755
5,228,159 A * 7/1993 Gurka ..... 7/105
5,853,157 A * 12/1998 O'Donnell ..... 248/213.2
6,640,369 B1 * 11/2003 Malvasio ..... 7/105
2007/0285824 A1 * 12/2007 Cornelissen ..... 360/69

FOREIGN PATENT DOCUMENTS

WO WO 2008/017729 A1 2/2008

OTHER PUBLICATIONS

Jun. 14, 2013 International Search Report And The Written Opinion Of The International Searching Authority, or the Declaration, in PCT/US2013/033586, Dennis Tuohy III, et al., Applicants, 8 pages.

* cited by examiner

*Primary Examiner* — Robert Scruggs
(74) *Attorney, Agent, or Firm* — Meagher Emanuel Laks Goldberg & Liao, LLP

(57) ABSTRACT

A multipurpose tool is disclosed. The multipurpose tool is formed as a flexible material comprising a proximate region, a distal region and a substantially flat and straight intermediate region disposed therebetween and having a jagged side edge; a third hook is inwardly curved with respect to the straight intermediate region to provide an open portion directed toward the proximate region; a second hook is inwardly curved with respect to the straight intermediate region to provide an open portion directed toward the distal region; a first hook formed on an outer surface of the second hook and having an open portion directed away from the distal region; and a clip formed on an inner surface of the second hook and having an open portion directed toward the distal region.

20 Claims, 14 Drawing Sheets

400

500

800

900

1000

1200

MULTI-PURPOSE TOOL

CROSS-REFERENCE TO RELATED APPLICATIONS

This application claims the benefit of U.S. Provisional Patent Application Ser. No. 61/797,650, filed Dec. 12, 2012, entitled "PAINTER'S MULTI-TOOL," which application is incorporated herein by reference in its entirety.

FIELD OF THE INVENTION

The present invention relates to a multipurpose apparatus and, more particularly to a multipurpose tool for aiding in multiple different activities associated with painting.

BACKGROUND OF THE INVENTION

To paint a small or large area, a minimum amount of equipment is required. For example, a list of the items needed to perform the task would include a tool to open a can of paint, a paintbrush, a pail (touchup container), roller, roller tray, a rag, roll of tape, a scraper/putty knife, a brush comb, a brush repository and so on. While generally not very expensive, the various tools do require investment in terms of money, storage space and so on to keep track of necessary tools for subsequent jobs.

SUMMARY OF THE INVENTION

Various deficiencies of the prior art are addressed by a multipurpose apparatus or tool adapted to support multiple different activities associated with painting. The multipurpose tool comprises a flexible material having a proximate region formed as a scraper and including first and second semicircular hook, a distal region including a third semicircular hook, and a straight intermediate region therebetween having a jagged side edge or toothed portion. The first semicircular hook comprises an inner surface with a clip formed thereon.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

The invention will be primarily described within the context of particular embodiments; however, those skilled in the art and informed by the teachings herein will realize that the invention is also applicable to other technical areas and/or embodiments. For example, since the various embodiments of an apparatus or tool are well adapted to painting related activities, the invention is also applicable to any type of activity in which a coating such as paint, varnish and the like is applied to a surface. Moreover, though the various embodiments are directed to an apparatus or tool well adapted to painting related activities, various features associated with the apparatus or tool may be successfully used within the context of non-painting related activities. Thus, those skilled in the art may readily devise many other varied embodiments that still incorporate these teachings.

Generally speaking, the present invention is a multi-purpose, multi-job tool or device that is small enough to fit in one's pocket. The multi-purpose tool is manufactured using, illustratively, a flexible plastic or metal material that will tend not to crack or break when exposed to temperature variations, mechanical stresses and the like as described herein. Various embodiments utilize ABS, polypropylene and the like. Although primarily described with respect to flexible plastic or metal, a semi-flexible plastic or metal, or any other material exhibiting characteristics consistent with the characteristics and applications discussed herein may also be used.

Figure 1:
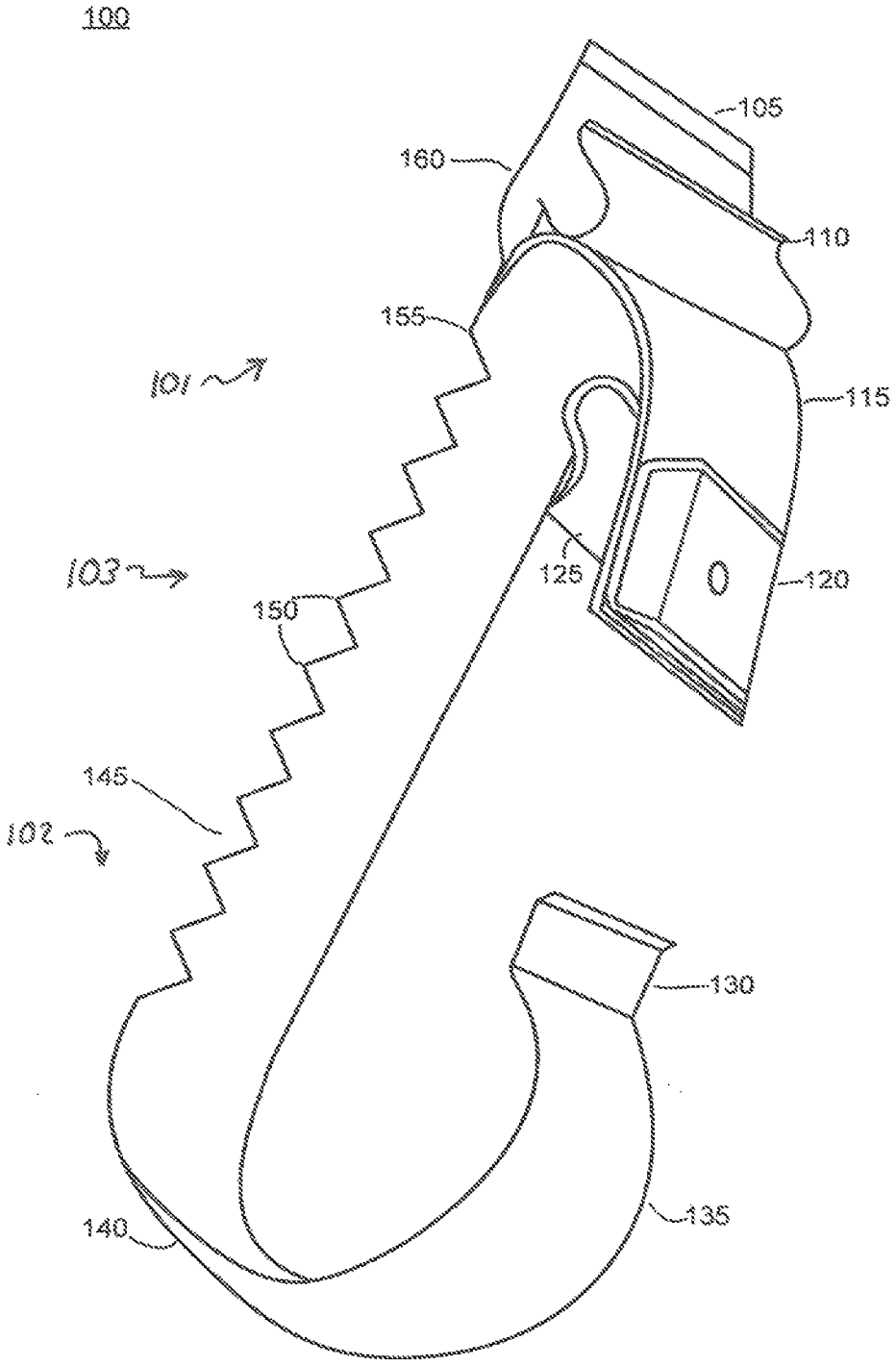
FIG. 1 depicts an exemplary multipurpose tool according to one embodiment.

FIG. 1 depicts an exemplary multipurpose tool according to one embodiment. Specifically, multi-purpose tool or device 100 includes two or more of a scraper or putty knife 105 described in reference to FIGS. 2A-2D, a first semicircular hook 110, a second semicircular hook 115, a magnetic assembly 120 described in reference to FIG. 4 and FIG. 14, a non-linear clip portion 125, a pressure handle portion 130, a roller cleaner 135 described in reference to FIGS. 12A-12C and FIGS. 14-15, a third semicircular hook ladder clip/painter tape/rag holder portion 140 described in reference to FIGS. 7-9, a handle for small pails 145 described in reference to FIG. 5, a toothed portion or jagged side edge 150 described in reference to FIGS. 11A-11C, a small pail clip 155 and a 1-gallon paint can opener 160 described in reference to FIGS. 3A-3B. The multipurpose tool comprises a flexible material having a proximate region 101 including a scraper end 105 and the first 110 and second 115 semicircular hooks, a distal region 102 including the third semicircular hook, and a straight intermediate region 103 therebetween having a jagged side edge or toothed portion.

Figure 2A:
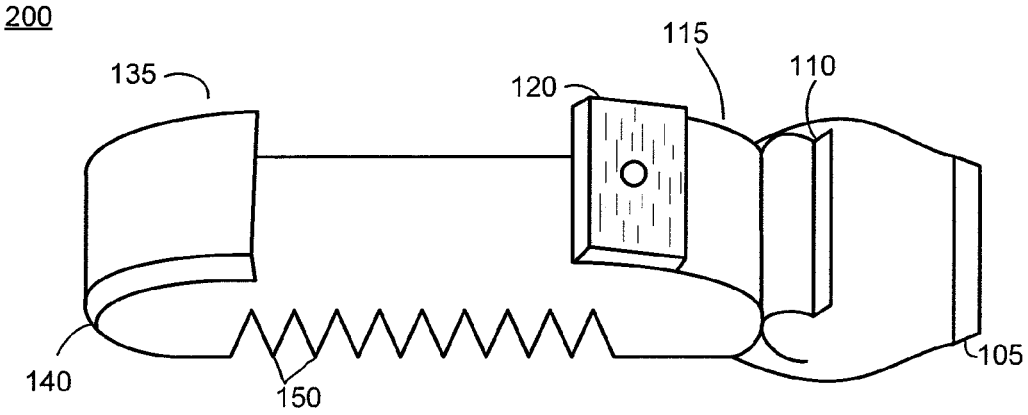
FIGS. 2A, 2B, 2C and 2D depict the scraper/putty knife of the exemplary multipurpose tool according to one embodiment.

The first step of a painting project often begins with preparing the surface to be painted. FIG. 2 depicts the scraper/putty knife of the exemplary multipurpose tool according to various embodiments. Specifically, FIG.2A depicts the front perspective view of multipurpose tool 100 showing scraper/putty knife 105, first semicircular hook 110, second semicircular hook 115, magnetic assembly 120, roller cleaner 135, third semicircular hook 140, and toothed portion 150 according to one embodiment.

Figure 2B:
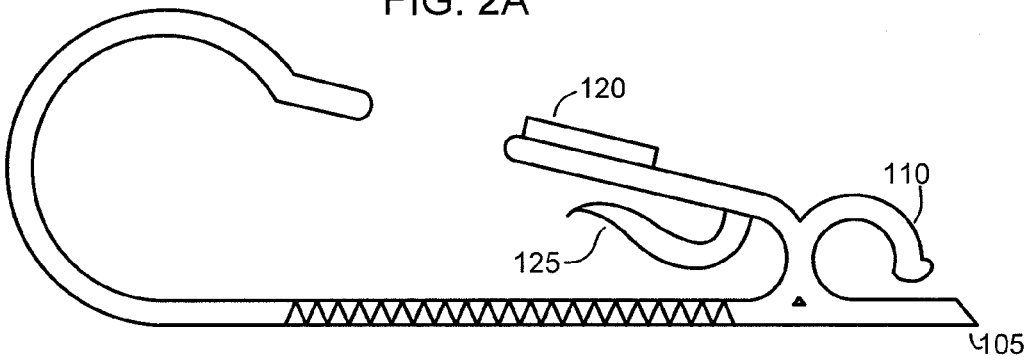

According to another embodiment, FIG. 2B depicts the right side view of multipurpose tool 100 illustrating scraper/putty knife 105, first semicircular hook 110, magnetic assembly 120 and non-linear clip portion 125.

Figure 2C:
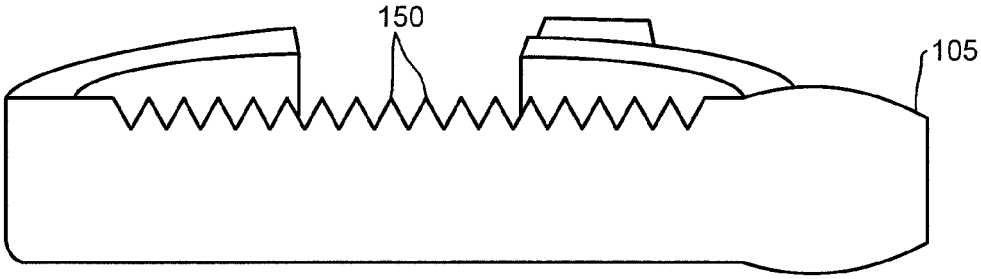

According to yet another embodiment, FIG. 2C depicts the back view of multipurpose tool 100 illustrating scraper/putty knife 105 and toothed portion jagged side edge 150.

Figure 2D:
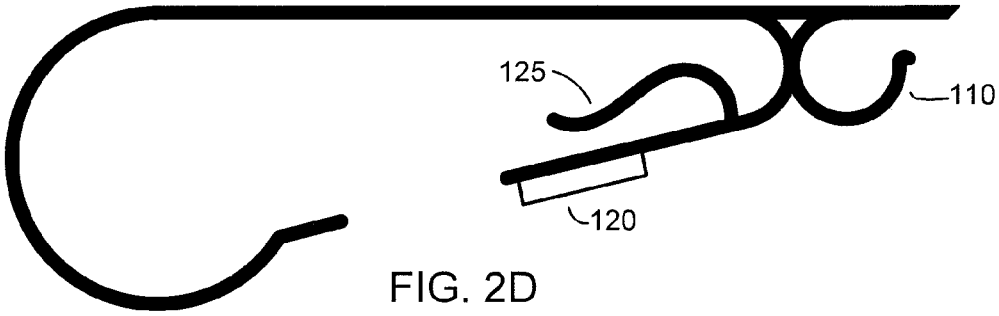

Additionally, according to another embodiment, FIG. 2D depicts the right side view of multipurpose tool 100 illustrating first semicircular hook 110, magnetic assembly 120 and non-linear clip portion 125.

Further, in one embodiment, the scraper or putty knife is used for filling holes. In another embodiment, the scraper or putty knife is used for smoothing a rough spot. In yet another embodiment, the scraper or putty knife is used for removing paint flakes. In various embodiments, multi-purpose tool enable better handling of painting instruments, e.g., paint brush, paint tape, pail, roller, roller tray and the like.

Figure 3A:
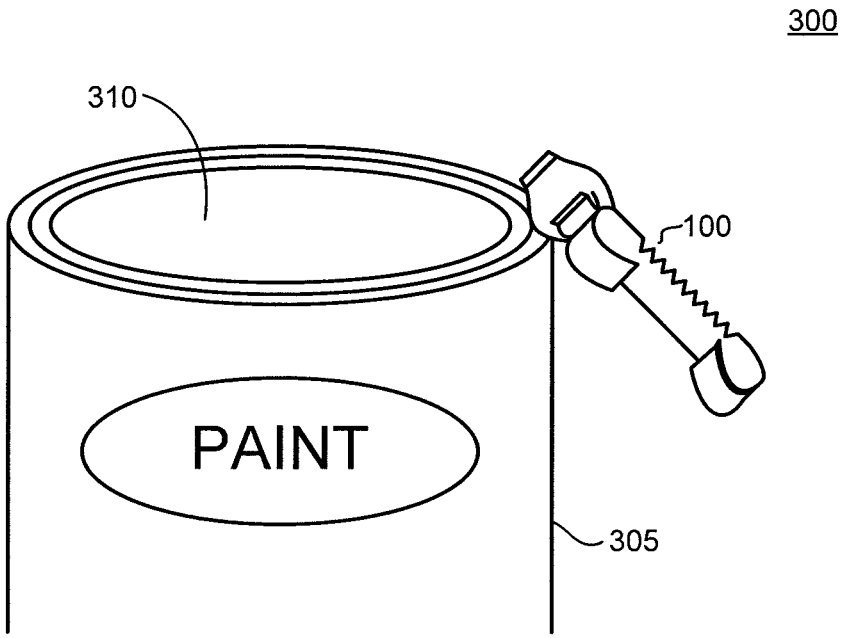
FIGS. 3A and 3B graphically illustrate the multipurpose tool attached to a can opener according to one embodiment.

FIG. 3 graphically illustrates multipurpose tool 100 being utilized to open a can of paint according to various embodiments. Specifically, FIG. 3A graphically illustrates multipurpose tool 100 being used as a can opener according to one embodiment. The next step of the project might entail opening a can. Multipurpose tool 100 is well suited for the task. As seen, multipurpose tool 100 lid 310 of the can of paint in order to pry the open the can of paint.

Figure 3B:
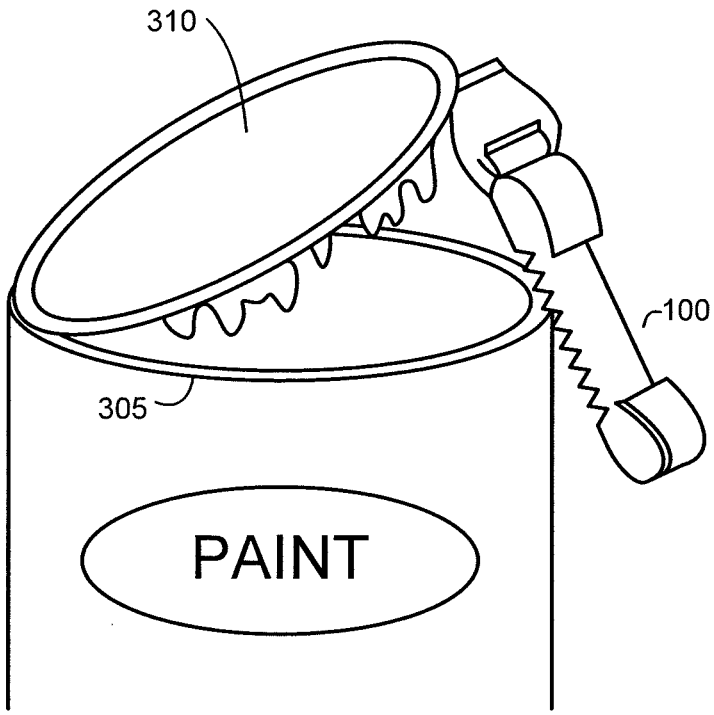

FIG. 3B graphically illustrates multipurpose tool 100 being attached to the can 305 according to another embodiment. In this embodiment, multipurpose device 100 is equipped with a built-in device 105 to pry open a metal can of paint 305. In another embodiment, multipurpose device 100 is used to open a can of varnish. Multipurpose device 100 works for both right and left handed individuals.

Figure 4:
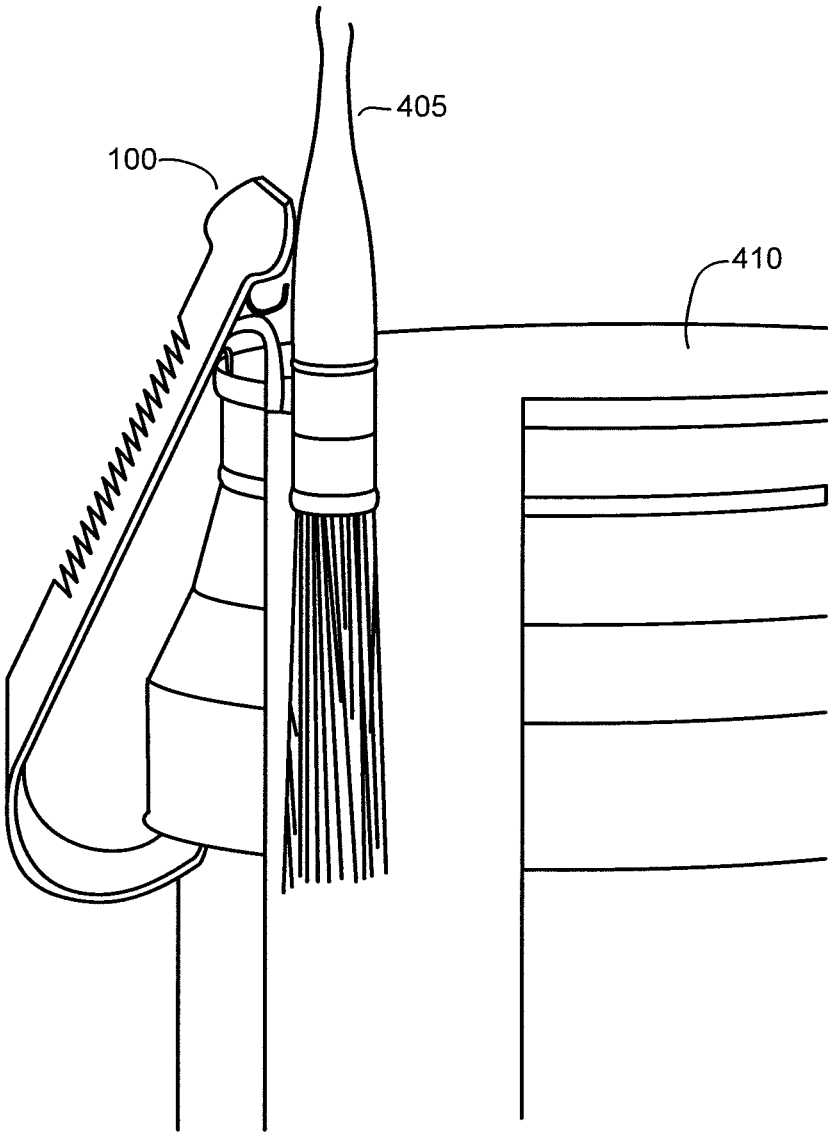
FIG. 4 graphically illustrates the magnet device of the multipurpose tool clamping to a paint brush according to one embodiment.

FIG. 4 graphically illustrates magnetic assembly 120 of multipurpose tool 100 being affixed to a paint brush according to one embodiment. Specifically, FIG. 4 shows multipurpose tool 100 being attached to paint brush 405 via a magnetic device, which is a component of magnetic assembly 120. Multi-purpose tool 100 is further attached to container 410 thereby holding paint brush 405 inside the container. Hence, brush 405 remains inside bucket 410 enabling the bristles to stay moist while keeping brush 405 out of the way.

Having opened a can, a next step may be to start applying the paint to the surface via a paint brush. Once that paint brush is inserted into the can or container of paint and loaded with paint, it may become difficult to handle. Quite often the brush is left dangling on top of the can, pail, touchup container or roller tray, or the brush is simply held, which only leads to accidents. Additionally, it is optimal to have the wet bristles stay moist. In various embodiments, this multi-purpose tool product clips to any size bucket or pail from 1-quart to 5-gallon buckets, 1 gallon paint and the like. In one embodiment, the multipurpose device has a strong magnet that sits inside, allowing wet brush 405 to sit inside the bucket or pail 410 while remaining ready-to-use and safely out of the way.

Figure 5C:
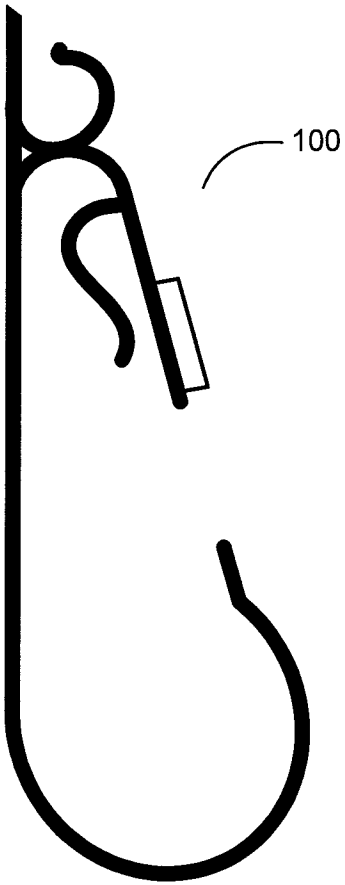
FIGS. 5A, 5B and 5C graphically illustrate the multipurpose tool being used as a handle for pint/quart size pails according to one embodiment.
Figure 5B:
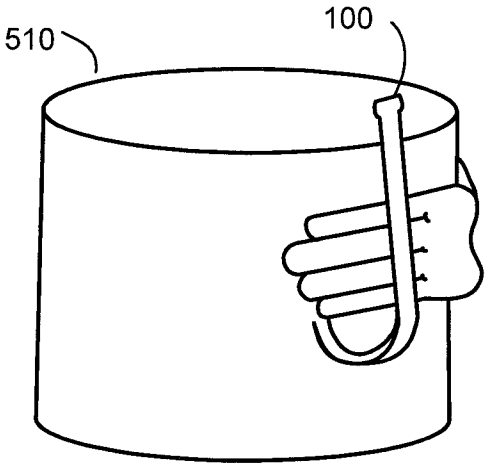
Figure 5A:
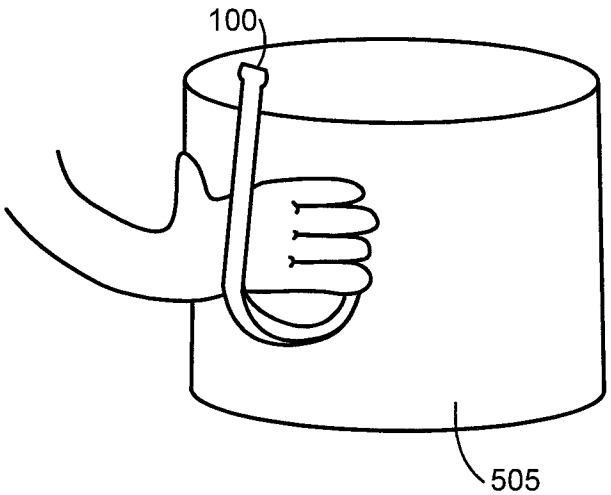

FIG. 5 graphically illustrates multipurpose tool 100 being used as a handle for pint/quart size pails according to one embodiment. Some projects such as varnishing, touch-up might only involve a smaller size pail. In one embodiment depicted in FIG. 5A, multipurpose tool 100 is attached to a pint size pail 505 to be used as a handle. In another embodiment shown in FIG. 5B, multipurpose tool 100 is attached to a quart size pail 510 to also be used as a handle.

Figure 6:
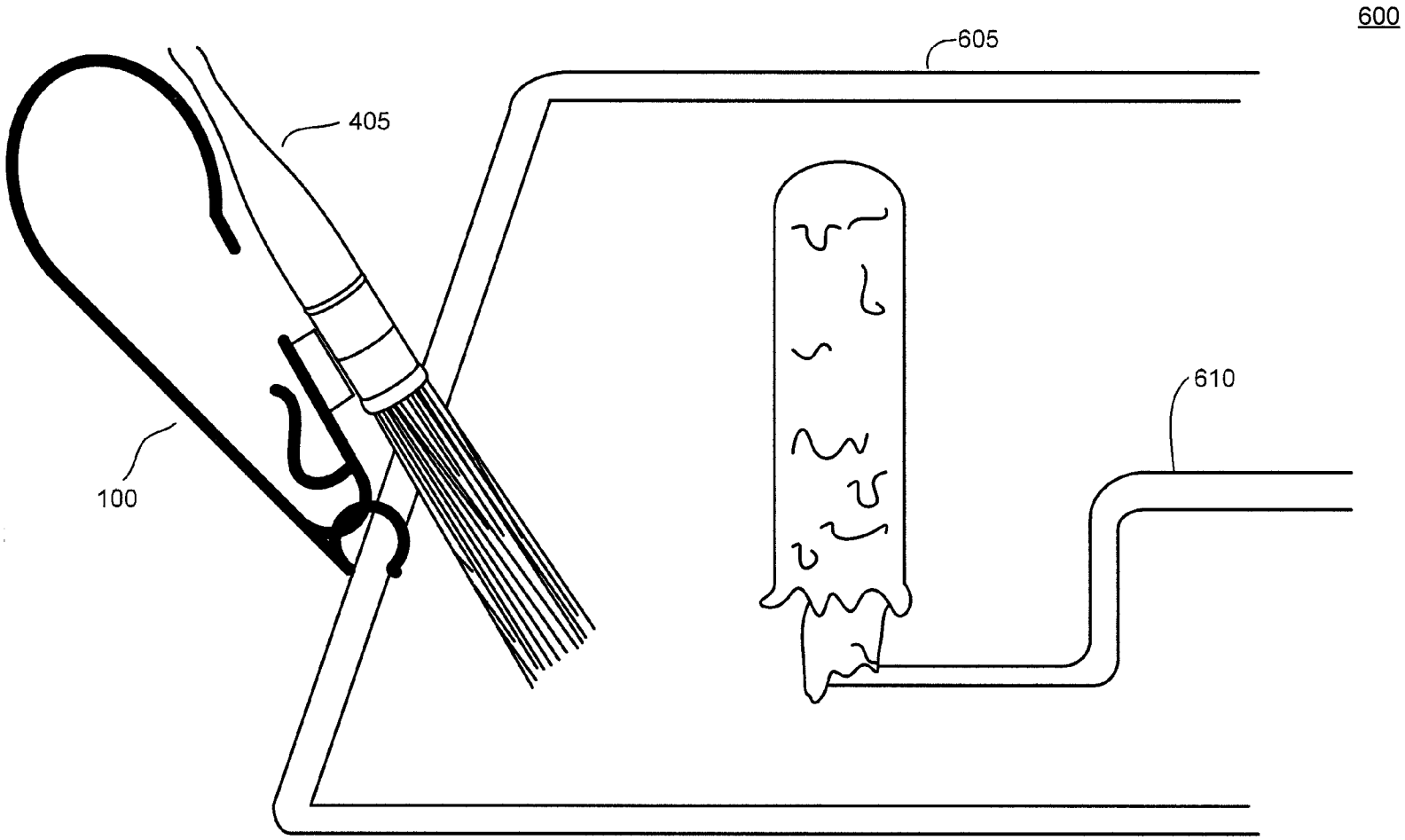
FIG. 6 graphically illustrates the multipurpose tool being attached to a roller tray according to one embodiment.

FIG. 6 graphically illustrates multipurpose tool 100 being attached to a roller tray according to one embodiment. Specifically, FIG. 6 shows multipurpose tool 100 being attached to paint brush 405 via magnet attachment 120. Paint brush 405 sits inside roller tray 605, which also houses roller 610. Frequently a painting project requires the utilization of a roller tray and roller in addition to the brush. In one embodiment, multipurpose tool 100 provides for attaching the tool to the roller tray while keeping paint brush 405 available when needed and still keeping those bristles moist. In other embodiments, paint brush 405 is kept soaking in cleaning agent or the like.

Figure 7:
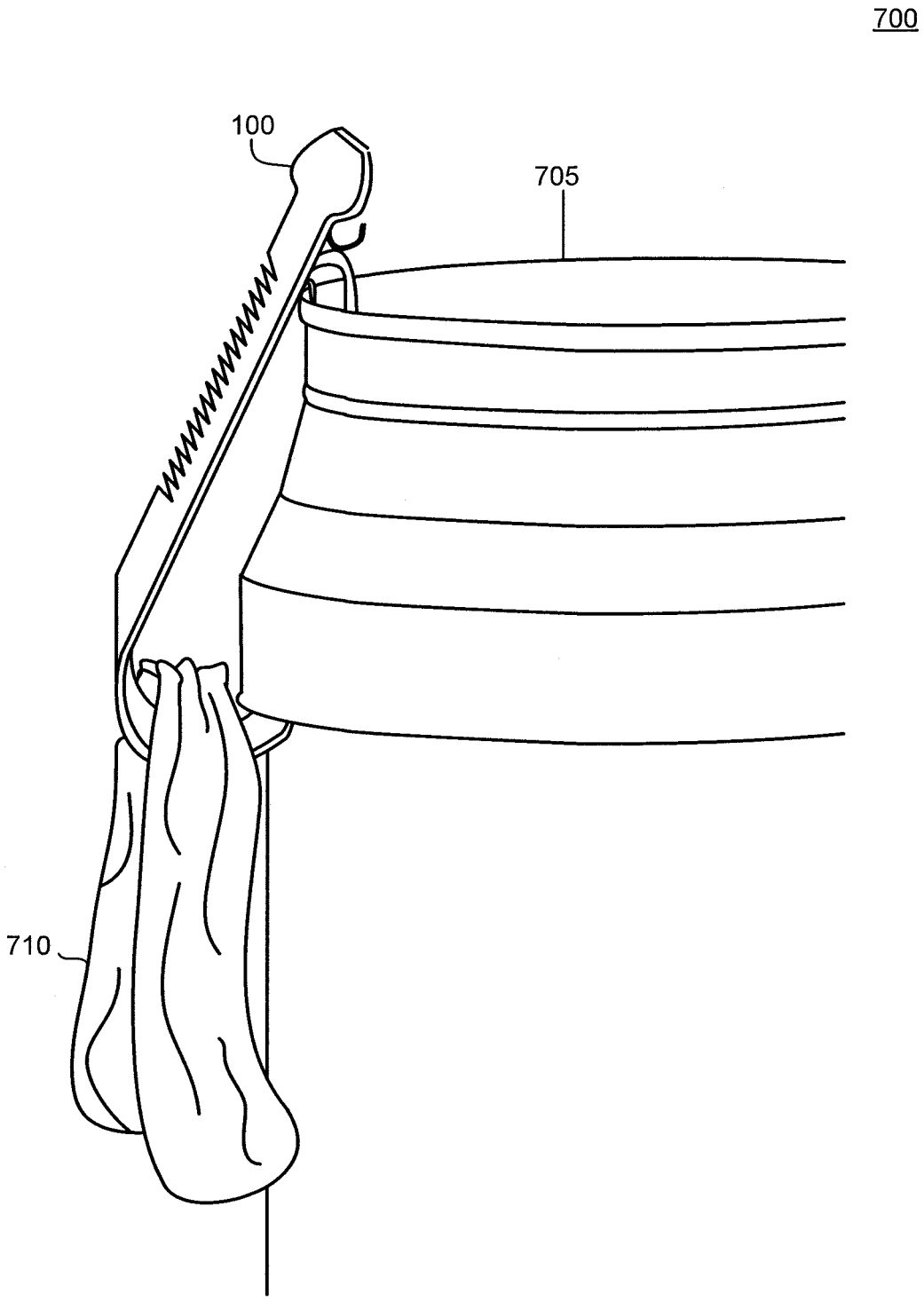
FIG. 7 graphically illustrates the multipurpose tool being used to drape one or more rags according to one embodiment.

FIG. 7 graphically illustrates the multipurpose tool being used to drape one or more rags according to one embodiment. Specifically, FIG. 7 shows multipurpose tool 100 being attached to container 705 while third semicircular hook portion 140 of multipurpose tool 100 accommodates one or more rags. In one embodiment, multipurpose tool 100 acts as a hook allowing a user to drape one or more rags on the bottom of the hook. In another embodiment, magnet attachment 120 is adapted to be placed on any metal surface and utilized in various ways. For example, the arrangement may be used as storage in work vehicles or shop; to hang a lightweight coat, dust mask, gloves, goggle holder, and items on a refrigerator and so on.

Figure 8:
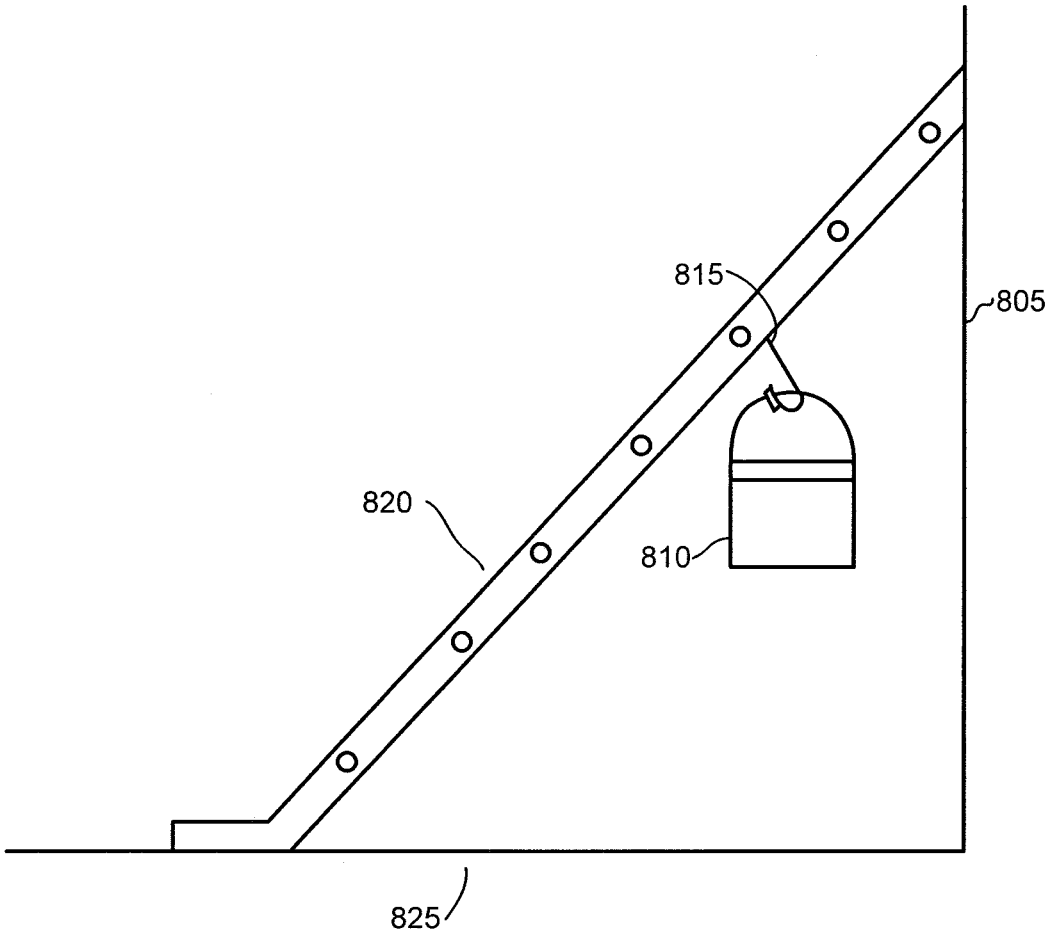
FIG. 8 graphically illustrates the multipurpose tool being used as a load bearing apparatus according to one embodiment.

FIG. 8 graphically illustrates multipurpose tool 100 being used as a load bearing apparatus according to one embodiment. FIG. 8 shows extended ladder 820 extending from ground level 825 to wall 805. New wider multipurpose tool 815 is attached to ladder 815. Multipurpose tool 815 supports the load of bucket of paint 810.

In various circumstances, a user may need to climb an extension ladder while simultaneously holding a container of paint. This situation could prove difficult. In one embodiment, multipurpose tool 100 clips to any rung of the ladder while supporting the load of a paint bucket, brush or other tools.

Figure 9:
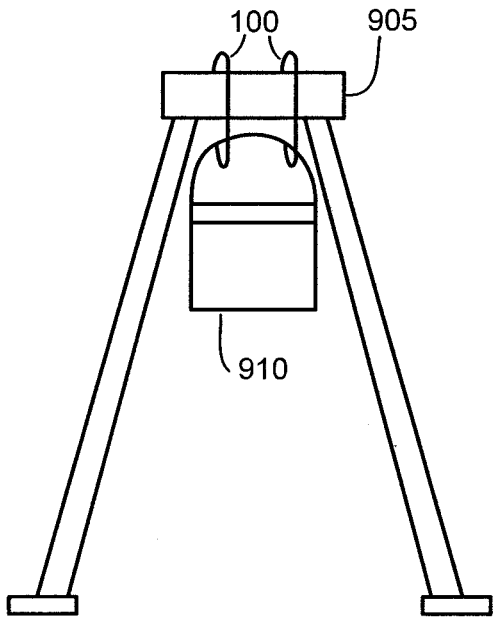
FIG. 9 graphically illustrates the multipurpose tool being used as a load bearing apparatus according to another embodiment.

FIG. 9 graphically illustrates multipurpose tool 100 being used as a load bearing apparatus according to another embodiment. Specifically, FIG. 9 shows a step ladder 905 providing a hole to anchor multipurpose tool 100, which supports the load of container 910. In one embodiment, multipurpose tool 100 is used with a step ladder that does not provide a folding material support.

Figure 10:
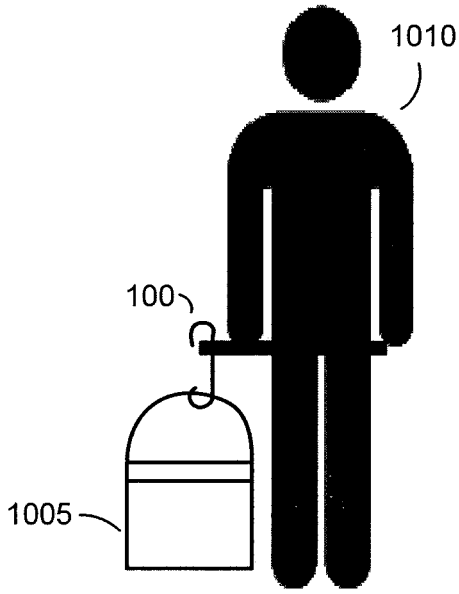
FIG. 10 graphically illustrates the multipurpose tool being used as a load bearing belt attachment according to one embodiment.

FIG. 10 graphically illustrates multipurpose tool 100 being used as a load bearing belt attachment according to one embodiment. Specifically, FIG. 10 shows user 1010 with multipurpose tool 100 attached to her/his belt supporting the load of container 1005. In one embodiment, user 1010 is working on the ground. In another embodiment, user 1010 is working on a ladder. In either case, multipurpose tool 100 clips to the belt holding needed items. In one embodiment, multipurpose tool 100 acting as a belt clip is adapted to carry a number of rolls of tape. In another embodiment, again multipurpose tool 100 acting as a belt clip is adapted to carry a bucket of paint. In various embodiments, other items are carried by multipurpose tool 100 acting as a belt clip.

Figures 11A, 11B, 11C:
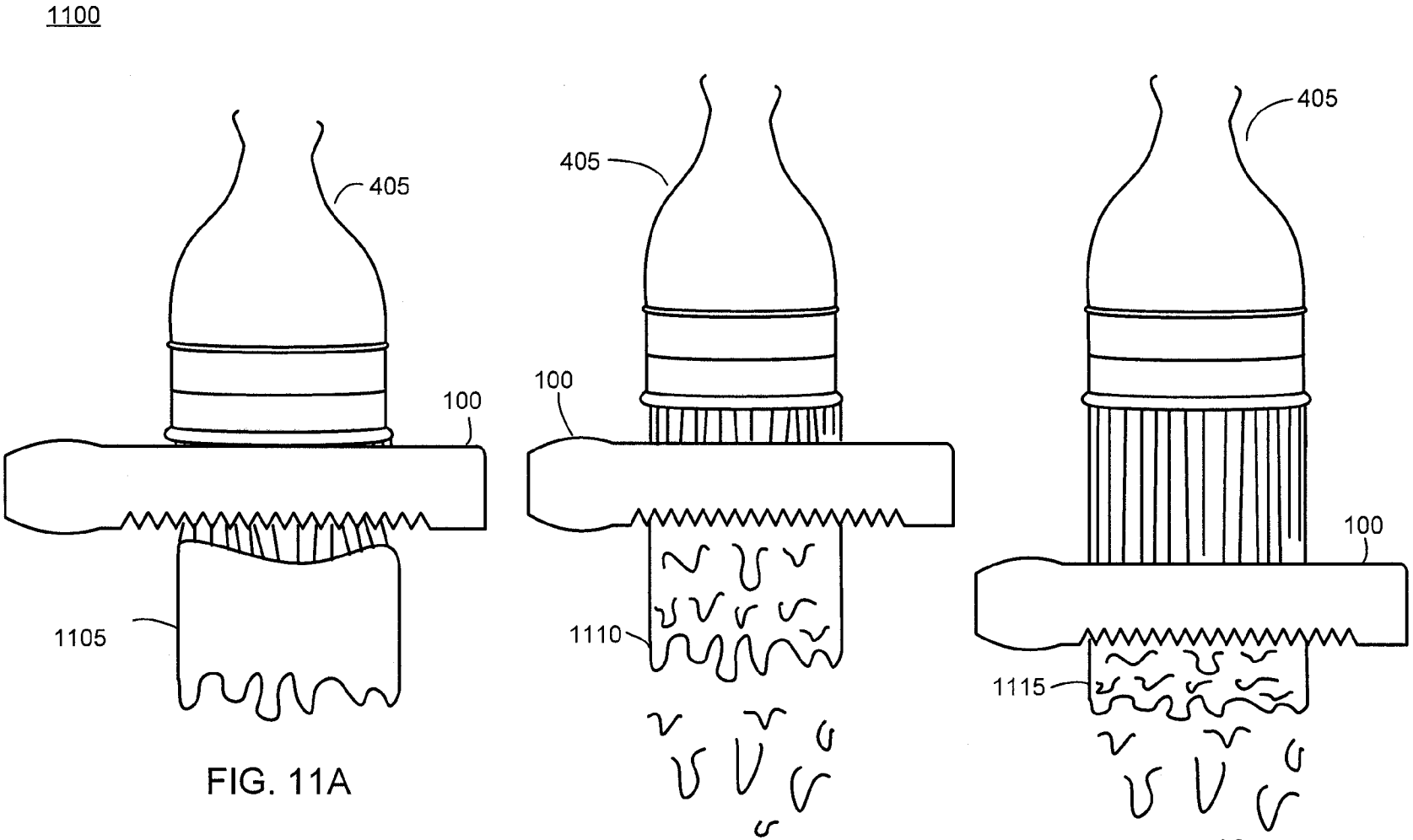
FIGS. 11A, 11B and 11C graphically illustrate the multipurpose tool being used to clean a paint brush according to one embodiment.

FIG. 11 graphically illustrates the multipurpose tool being used to clean a paint brush according to one embodiment. Specifically, FIG. 11A shows toothed portion or jagged side edge 150 of multipurpose tool 100 gripping the wet bristles of paint brush 405 while liquid paint 1105 drips away from brush 405. FIG. 11B shows multipurpose tool 100 progressing toward the end of brush 405. FIG. 11C shows multipurpose tool 100 progressing further toward the end of brush 405.

Clean-up may be everyone's favorite part of any job. In one embodiment, multipurpose tool 100 assists in making this part of the job a lot easier. Toothed portion or jagged side edge 150 built into one side of the tool allows a user to clean almost any paintbrush completely and easily. Although depicted as cleaning brush 405, multipurpose tool 100 is adapted to be used for various other tasks.

Figure 12A:
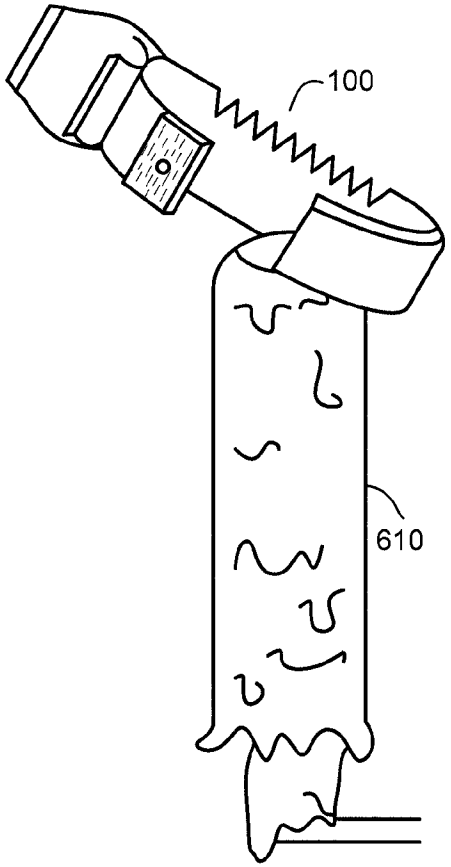
FIGS. 12A, 12B and 12C graphically illustrate the multipurpose tool being used to clean a roller according to one embodiment.
Figure 12B:
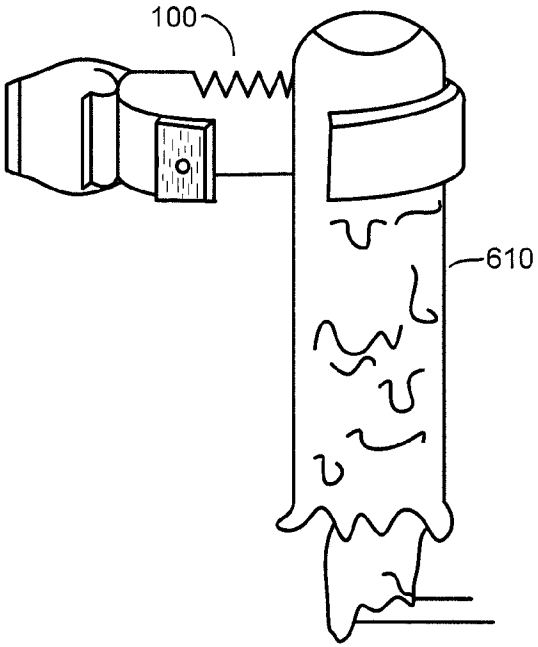
Figure 12C:
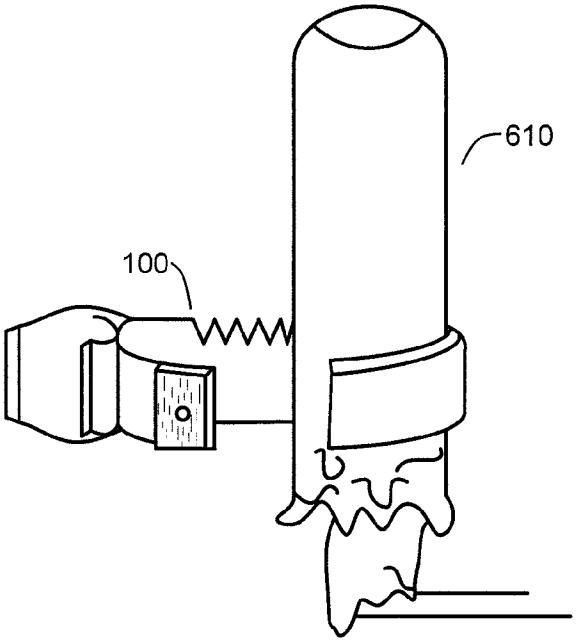

FIG. 12 graphically illustrates the multipurpose tool being used to clean a roller according to one embodiment. Specifically, FIG. 12A shows third semicircular hook 140 of multipurpose tool 100 gripping roller 610. FIG. 12B shows multipurpose tool 100 progressing toward the end of roller 610. FIG. 12C shows multipurpose tool 100 progressing further toward the end of roller 610.

Cleaning of a roller has never been easier. In one embodiment, third semicircular hook 140 of multipurpose tool 100 is adapted to squeeze out the excess paint when placed over one end of a paint filled roller, allowing the user to put the roller directly back into its original container and making cleaning the roller a breeze. In another embodiment, pressure handle portion 130 is used to provide added pressure to thereby remove a greater volume of liquid.

Figure 13A:
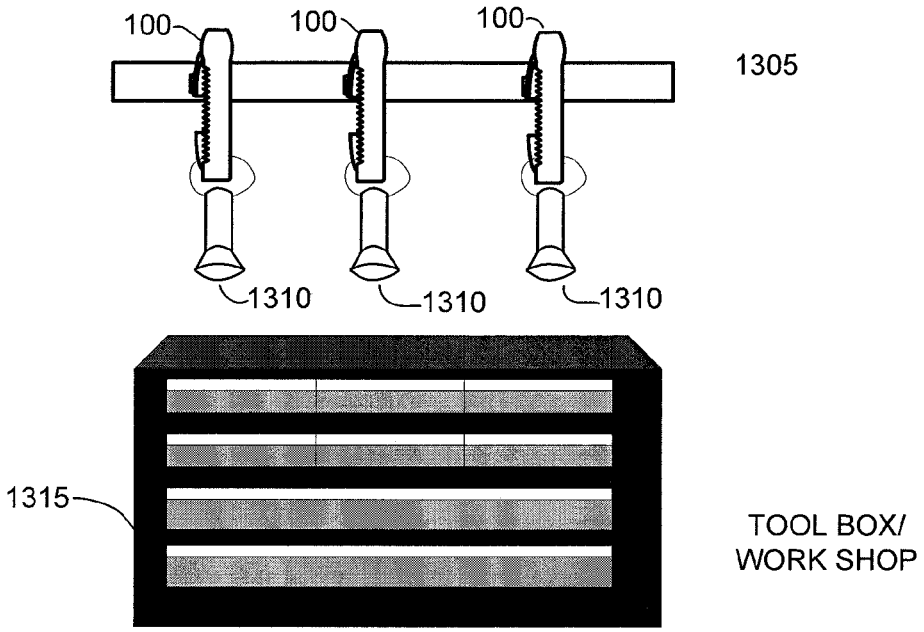
FIGS. 13A and 13B graphically illustrate the multipurpose tool being used as an organizer according to various embodiments.

FIG. 13 graphically illustrates the multipurpose tool being used as an organizer according to one embodiment. Specifically, FIG. 13A shows third semicircular hook 140 of multipurpose tool 100 used to organize a particular area of an environment. Multi-purpose tool 100 attaches to object 1305 while third semicircular hook 140 holds object/instrument 1305. Multi-purpose tool 100 is easily stored.

In various embodiments, multipurpose tool 100 is used to accomplish a plurality of tasks. For example, with the super strong magnet, multipurpose tool 100 is adapted to attach to any metal surface providing a plethora of uses including barbecue grill accessory holder, work vehicle organization, refrigerator utilization, tool box/work shop organization.

Figure 13B:
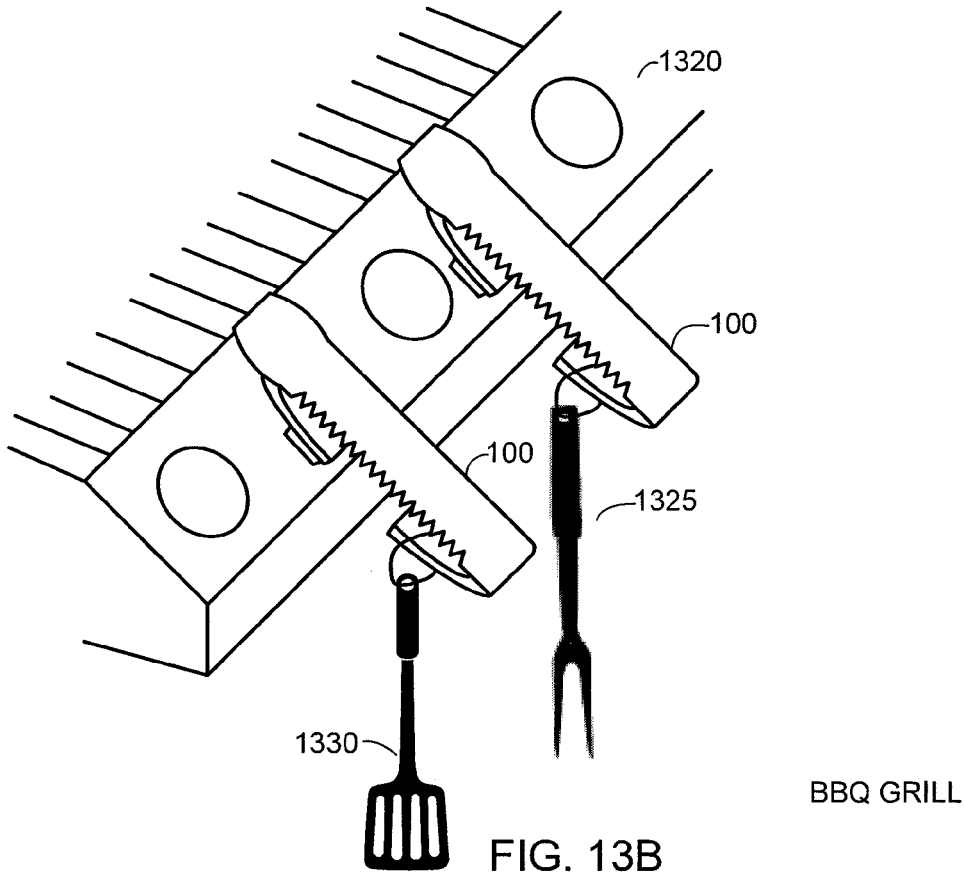

FIG. 13B shows magnet portion 120 of multipurpose tool 100 attaching to a barbecue-grill 1320 while third semicircular hook 140 anchors fork 1325 and flatware 1330.

In various embodiments, multipurpose tool 100 is used to handle a full gallon can of paint. As a result, the tool may be adapted to decrease its flexibility or increase its rigidity.

Figure 14:
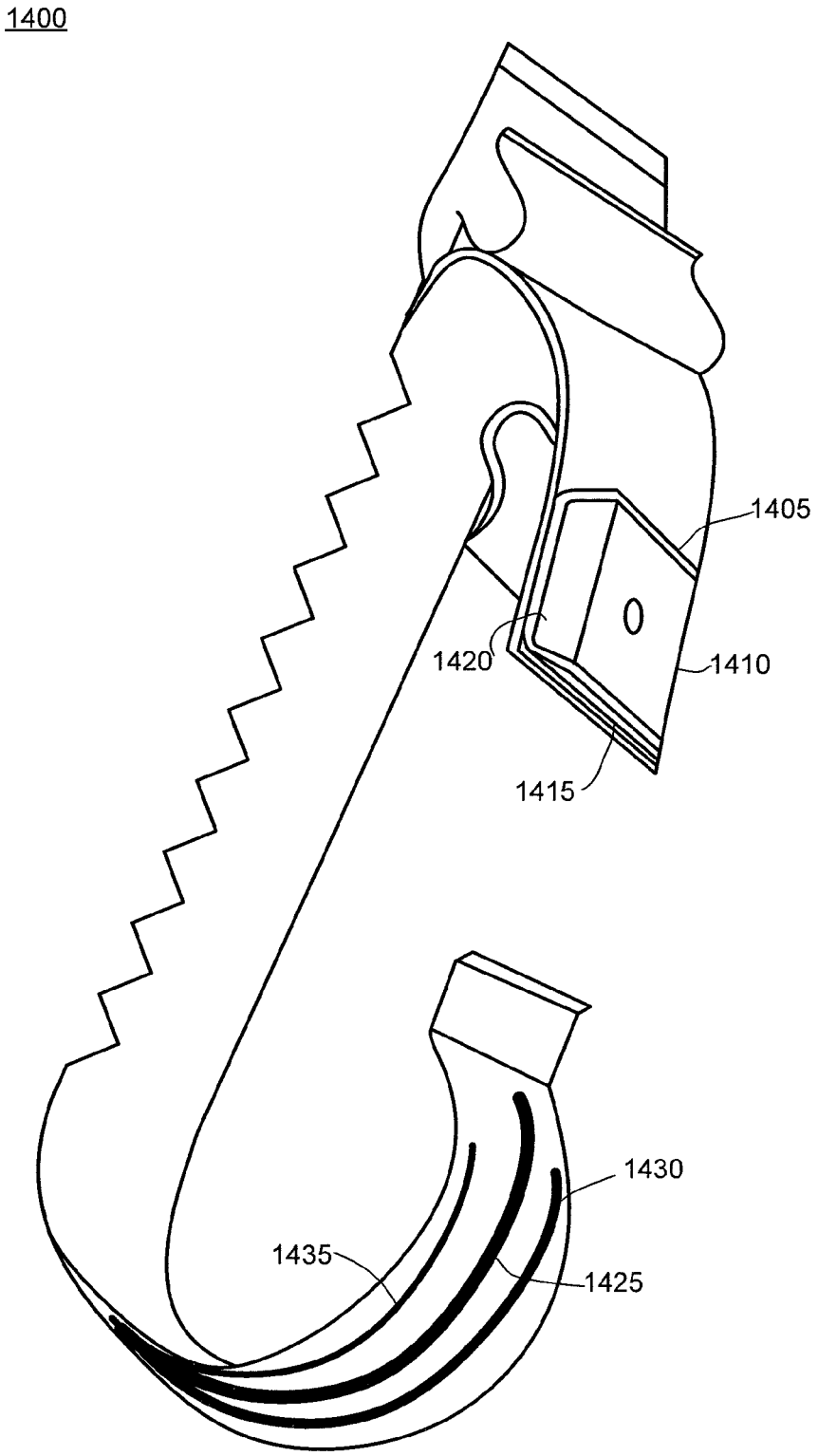
FIG. 14 depicts an exemplary embodiment of the multipurpose tool with a plurality of reinforcement spines and magnet cushions according to one embodiment.

FIG. 14 depicts an exemplary embodiment of the multipurpose tool with a plurality of reinforcement splines (or ribs) and magnet cushions according to one embodiment. Specifically, roller cleaner 135 is outfitted with reinforcement splines/ribs 1425, 1430 and 1435, which are further described with respect to FIG. 15. Although primarily described with respect to an embodiment where three reinforcement splines or ribs are used, any number of reinforcement splines or ribs may be used.

Moreover, the ceramic magnet or magnetic device may break or shatter if the multipurpose tool is dropped. Accordingly, the magnet is cushioned to attenuate a mechanical shock resulting from contact with a landing surface in the event that the multipurpose tool is dropped.

Magnetic assembly 120 is shown with top cushion 1405, right side cushion 1410, bottom cushion 1415 and left side cushion 1420. In various embodiments, magnetic assembly 120 comprises tracks or gaps on lower portion of inner area of top cushion 1405 and bottom cushion 1415 thereby forming a channel allowing the magnet device to be securely adhered to the magnetic assembly. Although primarily described with respect to an embodiment where top cushion 1405 and bottom cushion 1415 are used, any other arrangement may be used.

In one embodiment, magnetic assembly 120 comprises a protrusion.

Although primarily described with respect an embodiment where four cushions are used, any suitable number of cushions may be used.

Figure 15:
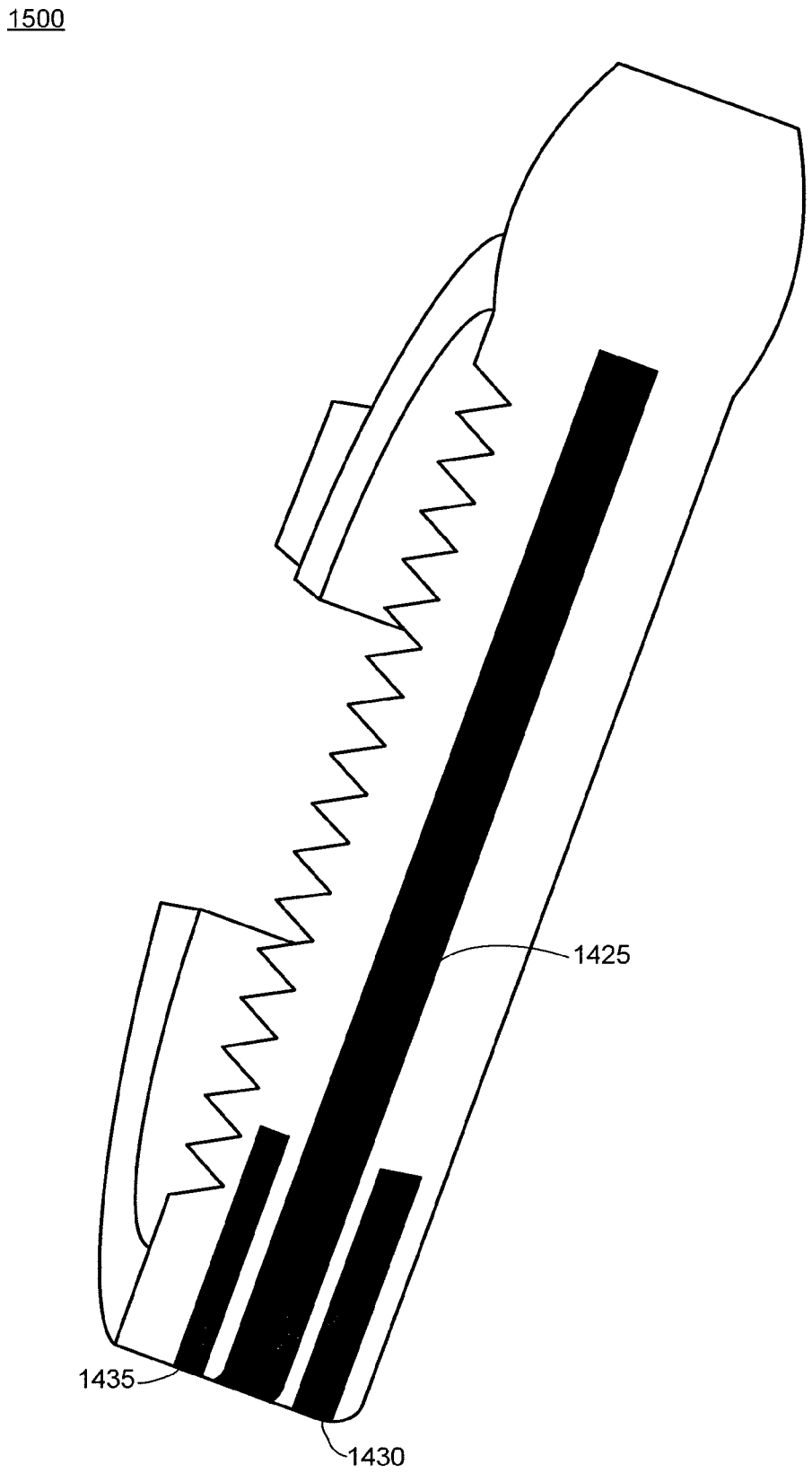
FIG. 15 depicts an exemplary embodiment of the multipurpose tool showing the length of the plurality of reinforcement spines according to one embodiment.

FIG. 15 depicts an exemplary embodiment of the multipurpose tool showing the length of the plurality of reinforcement splines (or ribs) according to one embodiment. The reinforcement splines/ribs are primarily used as a variable strength adjustment arrangement as described above. As such, the number, distance between reinforcement splines 1425, 1430 and 1435, the width of the reinforcement spines 1425, 1430 and 1435, the length of the reinforcement splines 1425, 1430 and 1435 and any combination thereof may be adapted to comply with the requirements of a specific situation or environment.

What is claimed is:

1. A multipurpose tool, comprising:

a flexible material comprising a proximate region, a distal region and a substantially flat and straight intermediate region disposed therebetween and having a jagged side edge;

a third hook inwardly curved with respect to the straight intermediate region to provide an open portion directed toward the proximate region;

a second hook (115) inwardly curved with respect to the straight intermediate region to provide an open portion directed toward the distal region;

a first hook (110) formed on an outer surface of the second hook and having an open portion directed away from the distal region; and a clip (125) formed on an inner surface of the second hook and having an open portion directed toward the distal region.

2. The multipurpose tool of claim 1, wherein said second hook further comprises an outer surface configured to receive a magnetic assembly.

3. The multipurpose tool of claim 2, wherein said outer surface of said second hook further comprises one or more protective cushions having a height greater than said magnetic assembly.

4. The multipurpose tool of claim 2, wherein said magnetic assembly comprises a magnet secured to a metal holder.

5. The multipurpose tool of claim 2, wherein said clip is configured to receive an edge of a paint holding container to thereby position said magnetic assembly within said paint holding container, said magnetic assembly being configured to magnetically secure a paint brush within said paint holding container.

6. The multipurpose tool of claim 1, wherein said outer surface of said second hook further comprises a second clip aligned with said scraper.

7. The multipurpose tool of claim 6, wherein the magnet portion comprises a plastic protrusion and one or more cushions located on top and bottom of the magnet.

8. The multipurpose tool of claim 1, wherein said clip is configured to receive a wire bucket handle for lifting a bucket thereby.

9. The multipurpose tool of claim 1, wherein said second hook is configured to receive a ladder step for hanging said multipurpose tool therefrom.

10. The multipurpose tool of claim 9, wherein the third hook is terminated by a flange.

11. The multipurpose tool of claim 10, wherein the flange is disposed at an acute angle with respect to the third hook.

12. The multipurpose tool of claim 1, wherein said first hook is defined by a first radius and said third hook is defined by a second radius, said first radius being smaller than said second radius.

13. The multipurpose tool of claim 1, wherein said first and third hooks include respective inner portions facing said intermediate region.

14. The multipurpose tool of claim 1, wherein said third hook includes an outer portion having disposed thereon a reinforcement spline.

15. The multipurpose tool of claim 1, wherein said third hook includes an outer portion having disposed thereon a plurality of reinforcement spines.

16. The multipurpose tool of claim 15, wherein said plurality of reinforcement splines comprise splines of at least two different lengths.

17. The multipurpose tool of claim 1, wherein the third hook includes a plurality of anchors to thereby provide a load bearing function.

18. The multipurpose tool of claim 1, wherein the multipurpose tool comprises one or more reinforcement splines placed on the outside contour of the multipurpose tool, the one or more reinforcement splines being of variable length and variable separation distance.

19. The multipurpose tool of claim 1, wherein the multipurpose tool comprises one or more reinforcement splines placed on the outside contour of the multipurpose tool, the one or more reinforcement splines being of equal length and equal separation distance.

20. The multipurpose tool of claim 1, wherein the third hook further includes a pressure handle portion configured to provide added pressure to a paint roller passing therethrough.

* * * * *